US007133001B2

(12) United States Patent
Mrstik et al.

(10) Patent No.: US 7,133,001 B2
(45) Date of Patent: Nov. 7, 2006

(54) INFLATABLE-COLLAPSIBLE TRANSREFLECTOR ANTENNA

(75) Inventors: A. Vincent Mrstik, Santa Barbara, CA (US); Michael A. Gilbert, Santa Barbara, CA (US); Michael P. Grace, Santa Barbara, CA (US)

(73) Assignee: Toyon Research Corporation, Goleta, CA (US)

( * ) Notice: Subject to any disclaimer, the term of this patent is extended or adjusted under 35 U.S.C. 154(b) by 9 days.

(21) Appl. No.: 10/978,823

(22) Filed: Nov. 2, 2004
(Under 37 CFR 1.47)

(65) Prior Publication Data

US 2005/0179615 A1 Aug. 18, 2005

Related U.S. Application Data

(60) Provisional application No. 60/516,280, filed on Nov. 3, 2003.

(51) Int. Cl.
*H01Q 15/20* (2006.01)

(52) U.S. Cl. ..... 343/915; 342/8; 342/10; 343/912

(58) Field of Classification Search ..... 343/912, 343/915; 342/8, 10
See application file for complete search history.

(56) References Cited

U.S. PATENT DOCUMENTS

| | | | | |
|---|---|---|---|---|
| 2,835,890 | A | 5/1958 | Bittner | |
| 2,977,596 | A * | 3/1961 | Justice | 343/872 |
| 2,989,746 | A | 6/1961 | Ramsay | |
| 3,112,221 | A * | 11/1963 | Price | 442/68 |
| 3,115,631 | A * | 12/1963 | Martin | 342/8 |
| 4,214,248 | A | 7/1980 | Cronson et al. | |
| 4,364,053 | A | 12/1982 | Hotine | |
| 4,672,389 | A * | 6/1987 | Ulry | 343/915 |
| 5,132,699 | A | 7/1992 | Rupp et al. | |
| 5,285,213 | A * | 2/1994 | Tusch | 343/915 |
| 6,115,003 | A * | 9/2000 | Kozakoff | 343/840 |
| 6,512,496 | B1 * | 1/2003 | Alexeff et al. | 343/915 |
| 6,650,304 | B1 * | 11/2003 | Lee et al. | 343/915 |
| 6,963,315 | B1 * | 11/2005 | Gierow et al. | 343/872 |

OTHER PUBLICATIONS

Proprietary Proposal to a Federal Agency by Toyon Research Corporation, Feb. 1996, U.S. Appl. No. 60/516,280, filed Nov. 3, 2003 entitled "Large-Aperture, Lightweight Antennas for Lighter-Than-Air Platforms".

Report by Toyon Research Corporation, Gilbert and Mrstik, "Large Aperture Antennas for Lighter-Than-Air Platforms", DARPA Order No. E175/01, issued by U.S. Arm Missile Command Under Contract No. DAAH01-96-C-R203, Feb. 1998.

Barab et al., "The Parabolic Dome Antenna:A Large Aperture, 360 Degree, Rapid Scan Antenna, Toroidal Microwave Reflector", IRE National Convention Record, Part I, 1956.

Ruze, "Lateral-Feed Displacement in a Paraboloid", IEEE Transactions on Antennas and Propagation, vol. AP-13, Sep. 1965, pp. 660-665.

Mrstik, "Scan Limits of Off-Axis Fed Parabolic Reflectors", IEEE Transactions on Antennas and Propagation, vol. AP-27, Sep. 1979, pp. 647-650.

(Continued)

*Primary Examiner*—Tan Ho
(74) *Attorney, Agent, or Firm*—Nixon & Vanderhye P.C.

(57) ABSTRACT

A large aperture lightweight antenna uses an inflatable spherical surface deployed within a lighter than air platform. Beam steering is accomplished by moving the RF feedpoint(s) with respect to the reflector. The antenna can use an inflatable collapsible transreflector.

64 Claims, 12 Drawing Sheets

OTHER PUBLICATIONS

Li, "A Study of Spherical Reflectors as Wide-Angle Scanning Antennas", IEEE Transactions on Antennas and Propagation, vol. AP-7, Jul. 1959, pp. 223-226.

Peeler et al., "A Toroidal Microwave Reflector", IRE National Convention Record, 1954, pp. 242-247.

* cited by examiner

Fig. 2B
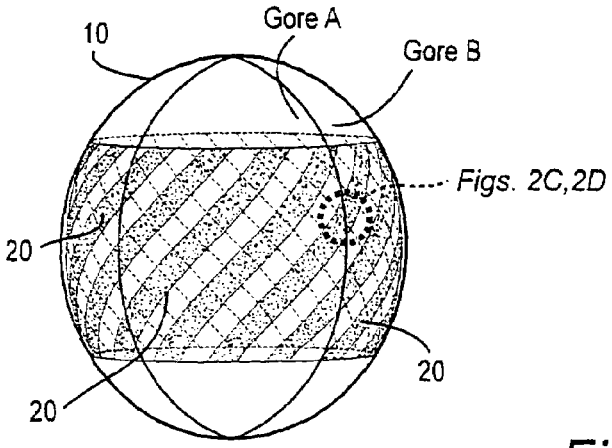
Fig. 2C
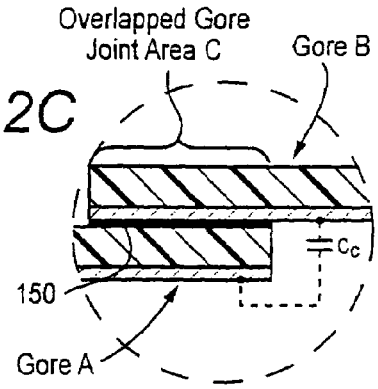
Fig. 2D
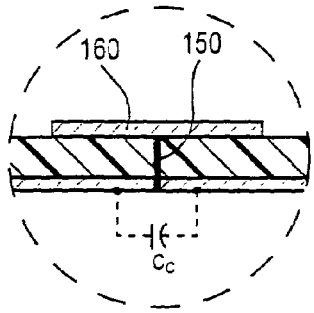
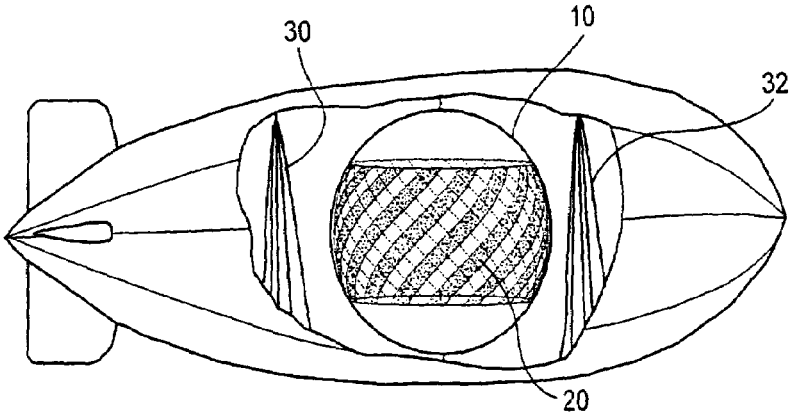
Fig. 3A
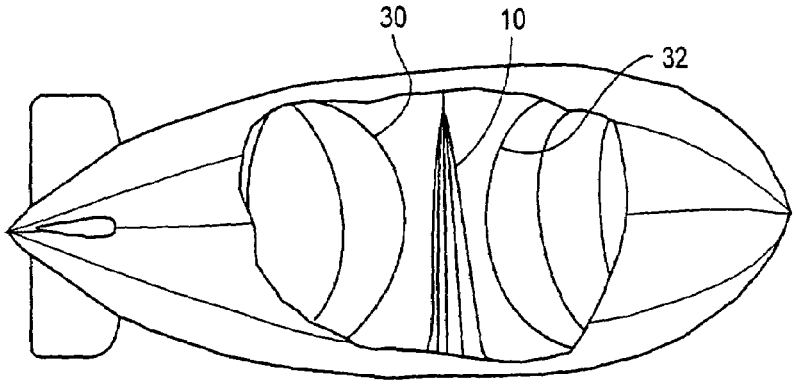
Fig. 3B

| EXAMPLE SPHERICAL REFLECTOR | | |
|---|---|---|
| | X-Band | UHF |
| Reflector Diameter, m | 20 | 20 |
| Effective Aperture Diameter, m | 6 | 12 |
| Directivity, dB | 55 | 35 |
| Beamwidth, deg | 0.3 | 2.5 |

INFLATABLE-COLLAPSIBLE TRANSREFLECTOR ANTENNA

RELATED APPLICATION

This non-provisional application claims the priority benefit under 35 U.S.C. §119(e) of provisional application 60/516,280 filed Nov. 3, 2003 (entitled LARGE-APERTURE, LIGHTWEIGHT ANTENNAS FOR LIGHTER-THAN-AIR PLATFORMS) the entire content of which is hereby incorporated hereinto by reference.

STATEMENT RE: FEDERALLY SPONSORED RESEARCH DEVELOPMENT

Parts of this invention were described in a February 1996 proprietary proposal to a Federal agency by Toyon Research Corporation.

Parts of this invention were also described in a related February 1998 report by Toyon Research Corporation with "Distribution limited to U.S. Government agencies only/Test and Evaluation; February 1998. Other requests for this document must be referred to Commander, U.S. Army Missile Command, Attn: AMSMI-RD-WS-DP, Redstone Arsenal, Ala. 35898-35248."

This report covered studies by Toyon sponsored by Defense Advanced Research Projects Agency (Information Technology Office), DARPA Order No. E175101, issued by U.S. Army Missile Command Under Contract No. DAAH01-96-C-R203.

BACKGROUND OF THE INVENTION

1. Field of the Invention

This invention relates generally to large aperture lightweight antennas. Such antennas are especially suited for use on lighter than air platforms. More particularly, this invention is especially well suited to provide inflatable and collapsible transreflector antennas.

2. Related Art

Lighter-than-air (LTA) vehicles such as manned airships (blimps), unmanned airships, or tethered aerostats have been used as platforms for radar and radio communication relays. However, since LTA lift capacity is reduced as the vehicle operates at higher altitudes, LTA vehicles require extremely lightweight antenna systems to function in this role at very high altitudes. Adding to the complexity of such antenna installations is the requirement for ballonets, or buoyancy control systems, to control the lifting force and allow controlled ascent and descent of the LTA vehicle. As the maximum altitude of the LTA increases, these ballonets occupy a larger fraction of the total volume within the LTA envelope. Ideally, the antenna would be collapsed or folded when the LTA is at low altitude (ballonets fully expanded) and the antenna would be fully deployed when the LTA is at high altitude (ballonets fully collapsed).

Scanning antennas utilizing transreflectors of spherical, parabolic, elliptical, or other toric sections are described in U.S. Pat. No. 2,835,890—Bittner, U.S. Pat. No. 2,989,746—Ramsay, and U.S. Pat. No. 4,214,248—Cronson et al. However, these antennas are not designed to be collapsible, are fabricated from thick metal rods or wires, or are comprised of multiple singly curved, reflective/transmissive surfaces. An inflatable spherical reflector is described in U.S. Pat. No. 4,364,053—Hotine but it is not collapsible nor capable of 360 degree scanning. A planar inflatable/collapsible antenna is described in U.S. Pat. No. 5,132,699—Rupp.

Although no published documentation is presently in hand, it is also believed others have previously recognized that an RF reflective conductive surface can have a thickness less than one RF skin depth.

A collection of possibly relevant prior art documents are identified below:

[1] K. S. Kelleher and H. H. Hibbs, "A New Microwave Reflector," NRL Report 4141, May 1953.

[2] J. D. Barab, J. G. Marangoni, and W. G. Scott, "The Parabolic Dome Antenna: A Large Aperture, 360 Degree, Rapid Scan Antenna, Toroidal Microwave Reflector," *IRE National Convention Record, Part* 1,1956.

[3] J. Ruze, "Lateral-Feed Displacement in a Paraboloid," IEEE Transactions on Antennas and Propagation, Vol. AP-13, Sep. 1965, pp. 660–665.

[4] A. V. Mrstik, "Scan Limits of Off-Axis Fed Parabolic Reflectors," IEEE *Transactions on Antennas and Propagation*, Vol. AP-27, September 1979, pp. 647–650.

[5] T. Li, "A Study of Spherical Reflectors as Wide-Angle Scanning Antennas," IEEE *Transactions on Antennas and Propagation*, Vol. AP-7, July 1959, pp. 223–226.

[6] G. Peeler and D. Archer, "A Toroidal Microwave Reflector," IRE National Convention Record, 1954, pp. 242–247.

[7] C. J. Sletten, *Reflector and Lens Antennas*, Massachusetts, Artech House, 1988.

[8] M. Gilbert and N. Williams, "A Hybrid Antenna System Incorporating a Parabolic Torus, "*Proceedings of the IEE Conference on Antennas and Propagation,* 1985, pp. 146–150.

[9] D. Paolina," Reflector Antennas Analysis Notes," NWC Technical Memorandum 5352, August 1985.

[10] A. W. Love, *Antenna Engineering Handbook*, New York, McGraw-Hill, 1984, Artech House, 1988.

[11] S. P. Applebaum, "Adaptive Arrays," *IEEE Transactions on Antennas and Propagation*, Vol. AP-24, September 1976, pp. 585–598.

[12] S. Silver, *Microwave Antenna Theory and Design*, London, Peter Peregrinus Ltd., 1984.

[13] U.S. Pat. No. 4,214,248—Cronson et al.

[14] U.S. Pat. No. 2,835,890—Bittner.

[15] U.S. Pat. No. 2,989,746—Ramsay.

[16] U.S. Pat. No. 4,364,053—Hotine.

[17] U.S. Pat. No. 5,132,699—Rupp et al.

[18] K. S. Kelleher and H. H. Hibbs, "A New Microwave Reflector," NRL Report 4141, May 1953.

[19] J. D. Barab, J. G. Marangoni, and W. G. Scott, "The Parabolic Dome Antenna: A Large Aperture, 360 Degree, Rapid Scan Antenna, Toroidal Microwave Reflector," IRE National Convention Record, Part 1, 1956.

BRIEF SUMMARY OF THE INVENTION

This invention provides, among other things, an exemplary embodiment using a transreflector-based antenna that is inflatable and which can be collapsed when not in use. This substantially eases integration of the antenna into an airship which can be the primary antenna platform. Several other types of inflatable antennas (including one spherical reflector, e.g., see U.S. Pat. No. 4,264,053—Hotine) are described in the prior art, but none are designed to be collapsible and have wide scan (e.g., 360-degree) capabilities.

Another feature of an exemplary embodiment of this invention is a possibly reinforced thin-film, single-wall spherical reflector construction with a thin metallized linear transreflector grating pattern. The metallized strips of the grating preferably have a width that is about half their center-to-center spacing which is, in turn, much less (e.g., <⅛) the shortest RF wavelength to be utilized by the antenna. This provides an extremely lightweight implementation for a transreflector.

In an exemplary embodiment, the metallization of the grating pattern can be much thinner than the RF current skin depth at a particular frequency to help minimize the transreflector weight.

An exemplary antenna capable of scanning a pencil beam through 360 degrees in azimuth and limited scan in elevation includes a stationary (with respect to a platform) transreflector, which may be an annulus of an inflatable/collapsible sphere. The surface of the sphere includes a thin, non-metallic film with thin, flexible metallization in a linear grating pattern oriented at 45 degrees with respect to the equator and increasing inclination with respect to the latitudes of the sphere as the grating "lines" approach the poles. A folding RF feed system can be used to illuminate a portion of the annulus as the feed system rotates about a concentric focal sphere or spherical annulus (whose radius is approximately half the transreflector sphere radius). The movable feed can produce an illumination pattern that is shaped to maximize gain and minimize sidelobes and to radiate with a polarization vector which is parallel to the reflective grating.

The preferred exemplary transreflector maintains a spherical shape owing to internal inflation gas pressure and the shape of the thin film membrane used to construct the transreflector surface. When this pressure is relieved, the reflector collapses around the feed system (which may also be folded for minimum total collapsed antenna volume).

The preferred exemplary folding RF feed system may provide a plurality of illuminating RF beams, possibly at differing radio frequencies. Such a plurality of beams may be utilized to increase the effective scan rate for a given feed system rotation rate or to decrease the feed system rotation rate for a given scan rate. In one exemplary embodiment, a turntable system of rotating feeds with constant rotation rate provides a surveillance function at one (lower) frequency while a separate set of independently steerable feeds positioned radially from the sphere center can provide dedicated tracking of a number of targets at a higher frequency. As the optimum feed radius decreases with increasing radio frequency of illumination, the two sets of feeds may avoid collision with each other. Each feed of an exemplary embodiment of the invention may be any of either horn, dipole, patch, notch, waveguide aperture, array or other radiator element whose polarization can be oriented at approximately 45 degrees with respect to the sphere's equator.

An exemplary embodiment of this invention allows the antenna to be readily collapsed to a much smaller volume than when in the fully deployed state, permitting the antenna to share the fully deployed volume when not in use with other structures that may be required for a vehicle which carries such an antenna. Since inflatable structures tend to approach a spherical shape, the single-wall inflatable sphere is the simplest and lightest shape for a stationary 360 degree scanning reflector antenna. The thin film sphere and thin grating metallization allows for an exceedingly lightweight structure that is much lighter than other transreflector shapes and construction methods to provide scanning capability over 360 degrees.

BRIEF DESCRIPTION OF THE DRAWINGS

FIGS. 2B–2D depict overlapped or butt joined gore sections of a spherical surface providing capacitive RF coupling (or direct electrical connection) between sections of the metallized transreflector grating strips.

FIGS. 3A and 3B are schematic illustrations of how the exemplary collapsible transreflector can allow for the antenna's deployed volume to be shared with other structures (in this case ballonets) when the antenna is not in use.

DETAILED DESCRIPTION OF EXEMPLARY EMBODIMENTS

Figure 1:
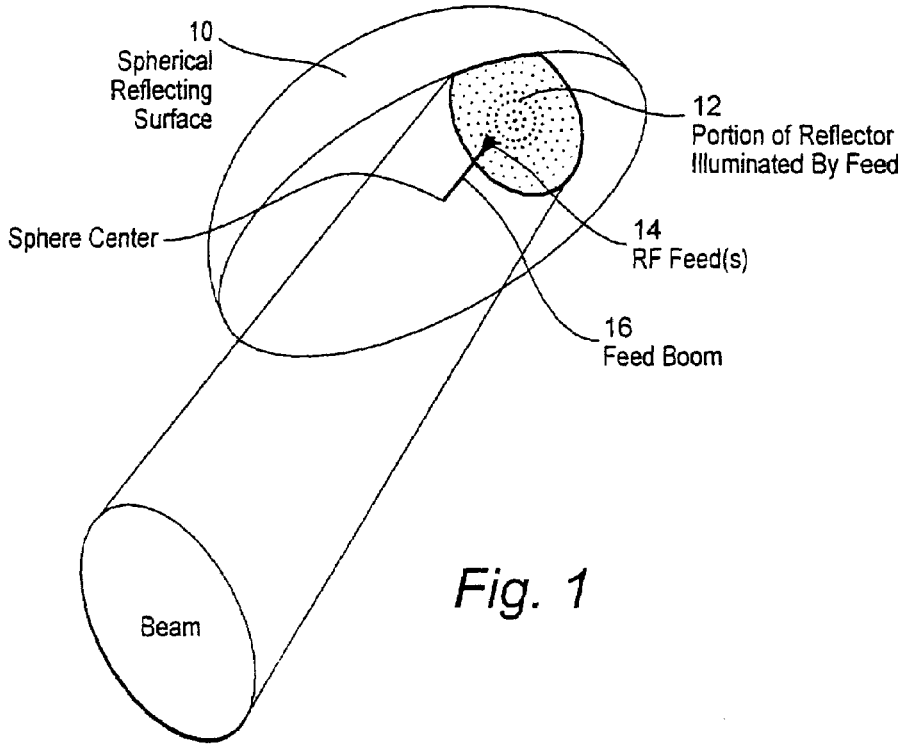
FIG. 1 is a schematic depiction of an exemplary spherical reflector antenna. By symmetry, the sphere can remain stationary while the feed is moved with no substantial degradation of beam quality with scan.

A presently preferred exemplary embodiment of this invention uses an inflatable-collapsible, spherical reflector antenna (specifically, a transreflector which substantially reflects RF waves from one internal side and which is substantially transparent to RF waves at an opposing side). The spherical transreflector 10 approximates an ideal parabolic shape over a limited portion 12 of the sphere that is illuminated by the feed(s) 14 (i.e., RF ports) as shown in FIG. 1. The reflector is fed at 14 using one or more horns, phased arrays, or other RF feed antennas mounted via a feed boom 16 or the like in the interior of the sphere positioned anywhere on the focal surface located approximately at the sphere half-radius. As will be appreciated by those in the art, the optimum feed location for maximum directivity, as limited by reflector phase errors, depends on the illumination frequency, illumination amplitude and phase, phase pattern, and the size of the reflector.

The beam is steered by moving the feed relative to the reflector rather than by moving the entire antenna structure (i.e., feed plus reflector) as is commonly done for conventional parabolic reflectors. An exemplary embodiment is used as a search radar antenna wherein scanning can be accomplished by sweeping the feed across the reflected image of the searched region. Since the transreflector is stationary (relative to the supporting antenna platform), it can be made from extremely lightweight RF transparent films (e.g., Mylar or other similar material).

Figure 2A:
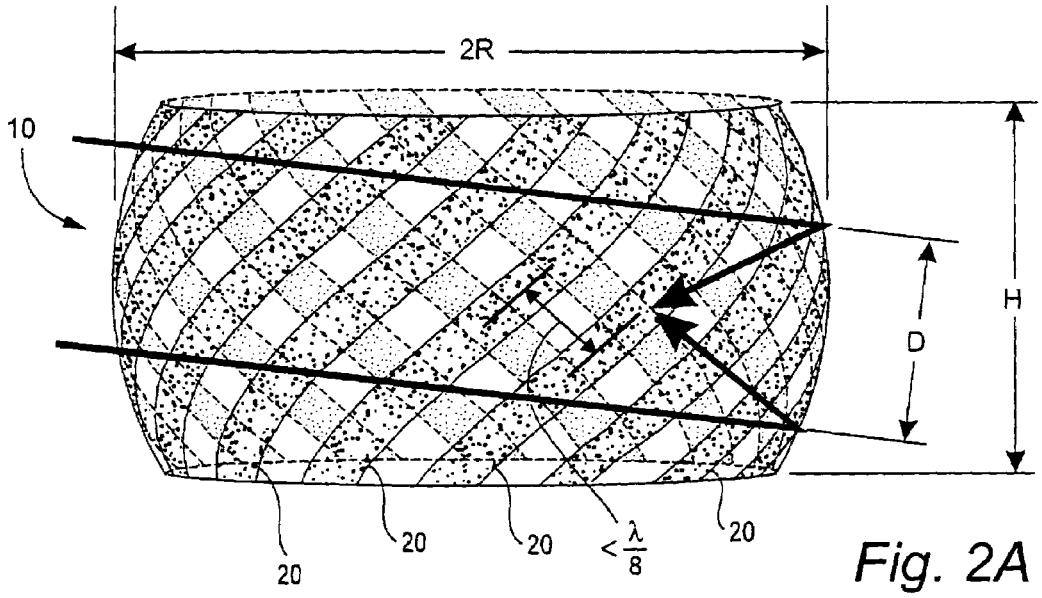
FIG. 2A is a schematic depiction of transreflector utilizing a spherical torus.

An exemplary transreflector surface can be constructed as an inflatable sphere using thin, non-metallic film with patterned, thin metallization strips 20 (as shown in FIG. 2A) to create a grating of parallel conductive "lines" or strips at a nominal angle of 45 degrees with respect to the sphere equator. When the feed illumination is linearly polarized collinear with the grating lines, the illumination will be reflected from the sphere into a collimated beam. On the other side of the sphere, the conductive grating lines are orthogonal, due to the wrap-around effect of the 45° grating pattern on a spherical surface which allows the wave to pass through the grating without significant attenuation. As will be appreciated, a reciprocal return path for incoming RF waves to a receiver port is also simultaneously provided.

As will be appreciated by those in the art, because it is an RF reflecting surface and not an RF current conducting surface, the metallization film traces can be much thinner than the RF current skin-depth required for low-loss transmission lines, further minimizing weight. However, the surface resistance of the metallization should be as low as possible for maximum grating efficiency.

To form a spherical inflatable surface, typically, specially cut pieces (or "gores") of flat material are used to create the doubly curved spherical surface (e.g., just like a basketball is sewn together from flat gores, e.g., see FIGS. 2B–2D). To calculate the amount of "give" in the material used, especially given the non-uniform strength of the material where the seams come together or if the material strength is non-isotropic can become quite a detailed engineering problem in its own right—for which others have developed their own numerical models for yielding precise shapes. For RF electrical purposes, the metallized gratings can simply be aligned on the separate gores (e.g., see overlapped gores A and B in FIG. 2C) using a lap joint (C in FIG. 2C) with a thin layer of adhesive 150 or other film-joining process to maintain the grating lines on overlapping adjacent gores A and B in as close proximity as possible to yield best capacitive coupling $C_c$ and RF performance. If a butt-joint is employed, the a short aligned metallized grating pattern 160 can be placed over the joint to provide RF coupling capacitance $C_c$. In particular, no DC contact between the metallization strips on successive gores is needed so long as there is sufficient overlap capacitative RF coupling $C_c$ therebetween. Of course, if desired, a direct DC contact can be provided. For example, a small trace of conductive paint (or the like) can be placed across each grating strip seam if butt-joints are used.

The scan capability of the exemplary system is unlimited in the azimuthal plane (the sphere's equatorial plane), while scanning in the elevational plane is limited by non-ideal orientation of the grating lines at opposite sides of the sphere which limits transreflector efficiency. A near-ideal grating orientation is only achieved when the beam is scanned along the sphere's equator. However, the grating orientation can be adjusted, if desired, at locations away from the equator to more closely achieve the desired orthogonality between the grating on reflection and transmission sides of the sphere when the beam is scanned away from horizontal. The polar caps of the sphere may be left free of metallization to reduce weight or one polar cap (typically the top) may be completely metallized while the opposite polar cap can be left free from metallization to allow expanded elevation scanning, even to vertical.

The exemplary transreflector 10 maintains a nearly spherical shape (as shown in FIG. 3A) through internal gas pressure and the shape of the thin film membrane used to construct the transreflector surface. A precision pressurization system may be required to maintain a more precise spherical shape. When this pressure is relieved, the reflector 10 collapses around the feed system as shown in FIG. 3B, which in a preferred exemplary embodiment is also folded for minimum stowed volume. By allowing the antenna to be readily collapsed to a much smaller volume than when in the fully deployed state, the volume of the fully deployed antenna may be shared when not in use with other structures (e.g., ballonets 30, 32) that may be required for a vehicle which carries such an antenna.

An advantage of the exemplary reflector design is that it can be quite broad-band, a capability that can be exploited by adding separate feeds at different frequencies or by using wideband feeds. For maximum efficiency over a wide frequency range, the center-to-center spacing of the grating strips should be a small fraction (e.g., <⅛) of the shortest RF wavelength used. This is schematically depicted by an $<\lambda/8$ arrow which also serves to indicate the grossly exaggerated scale of the grating as depicted in FIG. 2A. The width of the thin metallized grating strips should be half the spacing for optimum efficiency. Thus the preferred transreflector embodiment will have only about 50% of the spherical surface metallized. This saves weight as compared to fully metallized reflectors. The width and spacing of the grating may be narrowed toward the poles to maximize grating efficiency with elevation scan.

Figure 4:
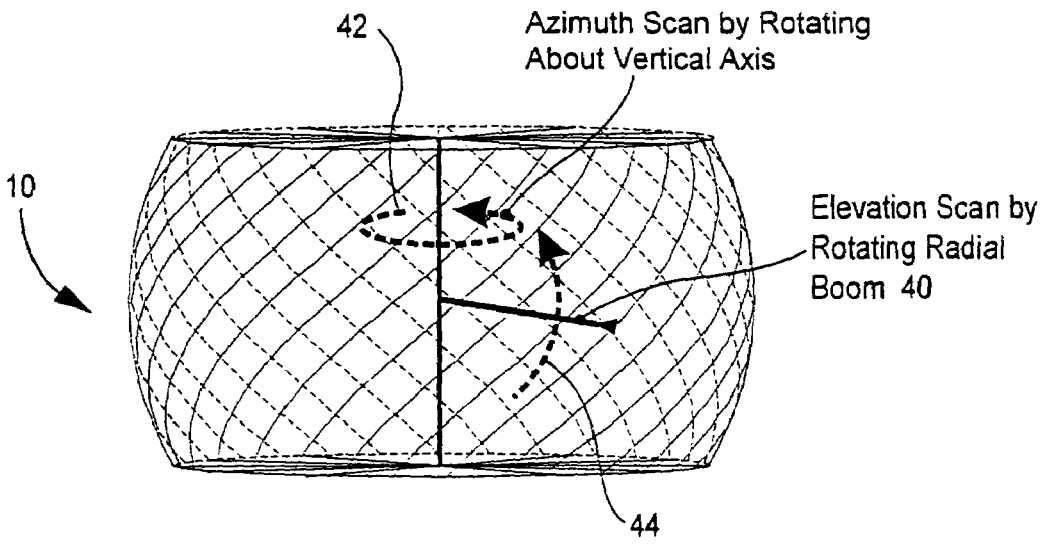
FIG. 4 is a schematic depiction of an exemplary feed antenna located on a radial boom.
Figure 5:
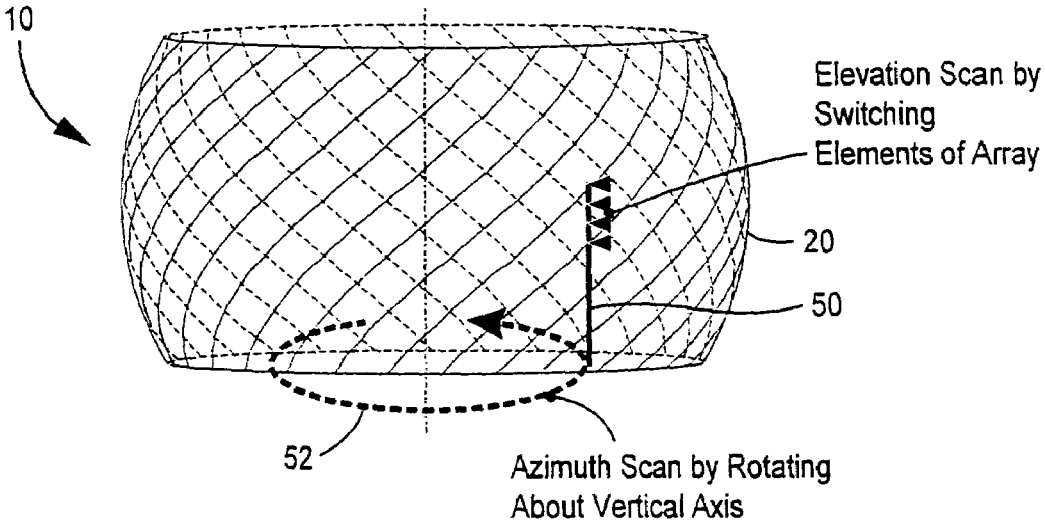
FIG. 5 is a schematic depiction of an exemplary feed antenna located on a rotating turntable.
Figure 6:
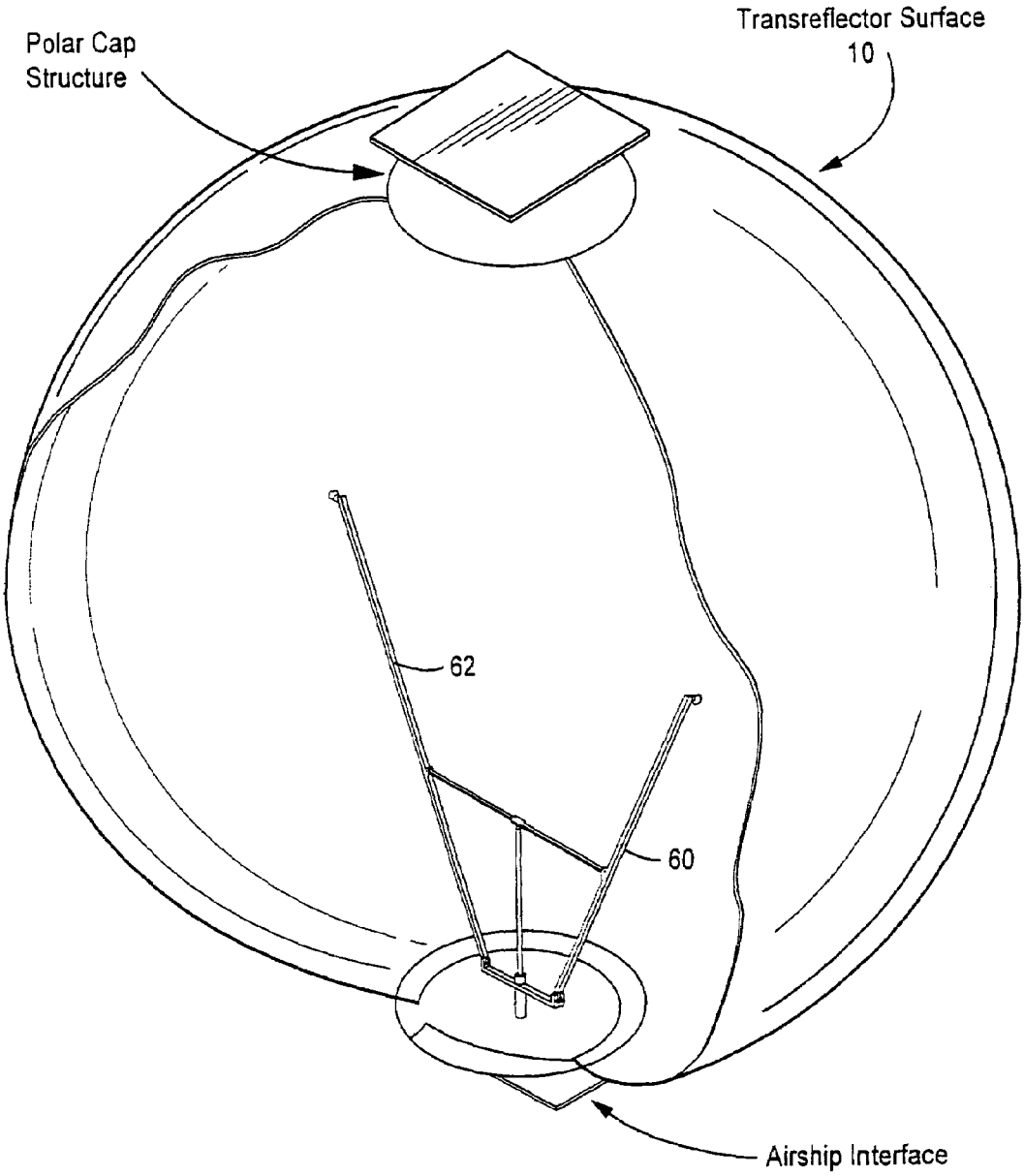
FIG. 6 is a schematic illustration of an exemplary embodiment of multiple feeds which slows the feed rotation rate for a fixed scan rate. Three, four, or more feeds can reduce the rotation rate further.

To support and scan the feeds within the spherical transreflector, several different exemplary embodiments are described. The first exemplary embodiment uses feeds mounted on radial boom(s) 40 from the center of the sphere as shown in FIG. 4. Scanning (shown by dotted lines 42, 44) is done mechanically in both azimuth and elevation. The second exemplary embodiment uses feed arrays fixed on vertical booms 50 scanned azimuthally at 52 by rotation about a vertical axis, as shown in FIG. 5. FIG. 6 illustrates another exemplary embodiment with two feed booms 60, 62 that are balanced to minimize oscillatory vibrations. An arrangement of four such feeds (two pairs) spaced at 90 degrees in azimuth provides twice the scan rate with minimal blockage. Further reductions in scan rate are possible with higher numbers of azimuth feeds, though lower directivity and higher sidelobes may result from the increased blockage. A fourth exemplary embodiment (not shown) may use a phased array feed in combination with any of the exemplary mechanical scanning systems to provide a higher degree of agility. The feed structure and feed antenna itself could also be inflatable structures. In all cases, the feeds may be folded and/or stowed in a configuration which allows the transreflector surface to be collapsed around the feed 70 for minimal volume as depicted in FIGS. 7, 8 and 9.

Figure 7:
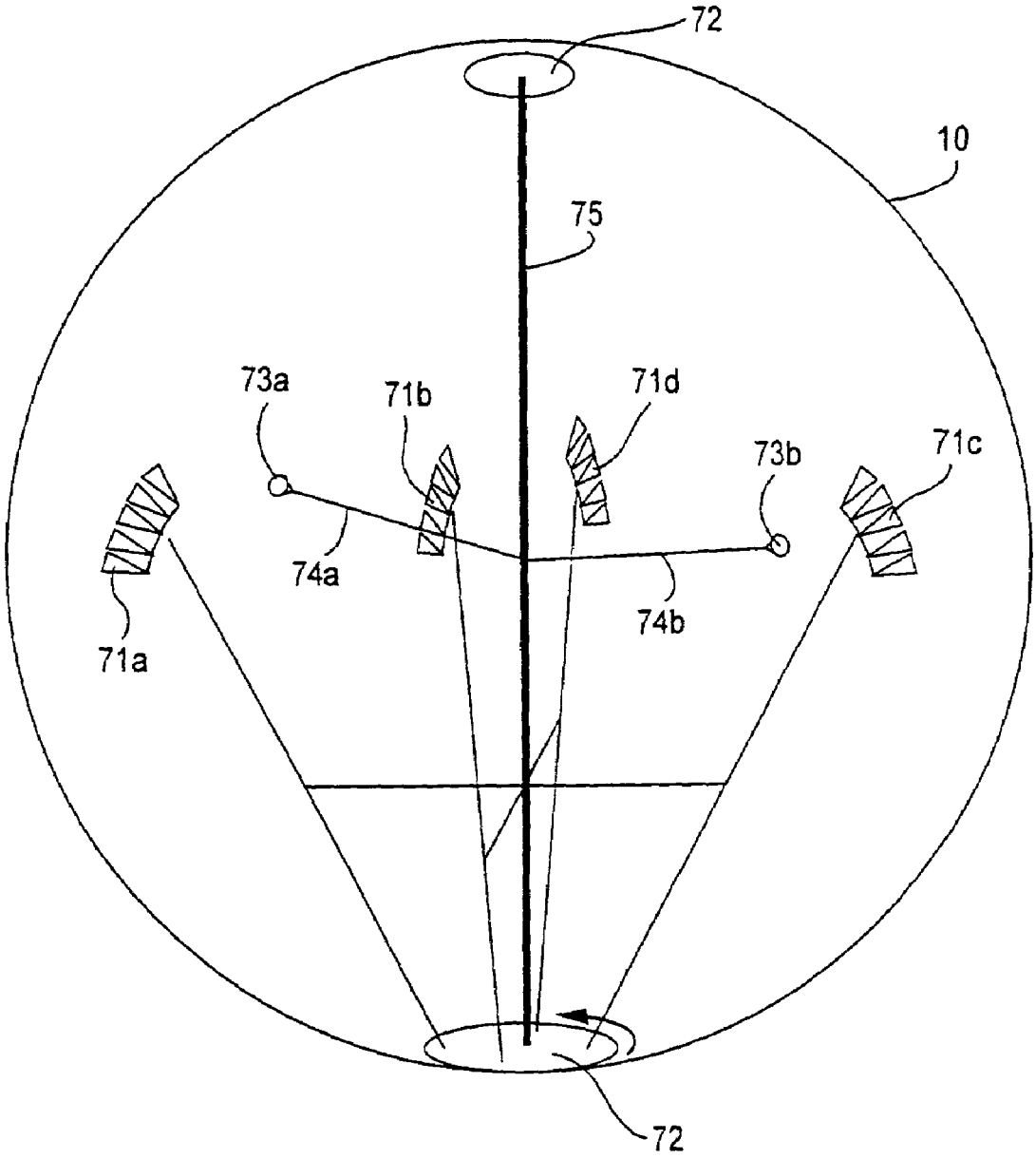
FIGS. 7, 8 and 9 provide schematic illustrations of how the exemplary multiple feeds of FIG. 6 can be folded to minimize the collapsed volume of the antenna.

FIG. 7 is a schematic diagram of four UHF horn arrays 71*a*–71*d* attached to a rotating turntable 72. In addition, two X-band feeds 73*a*–73*b* are carried on radial booms 74*a*, 74*b*. The low-frequency feeds 71*a*–71*d* are positioned on a focal sphere with radius $R_1 \sim R_{sphere}/2$, fixed or movable in elevation. The high-frequency feeds 73*a*–73*b* are positioned on a focal sphere with radius $R_2 < R_1$ and scannable in azimuth/elevation. Separate slip rings and hinges where lateral support linkages meet central pole 75 are provided for each high frequency feed to allow independent scanning. The low-frequency feeds 71*a*–71*d* rotate on single, or multiple, concentric turntable(s) 72 at either pole. Turntable rotation scans in azimuth. Reinforced polar caps provide a mechanical platform interface with the carrying platform. Central pole connecting polar caps form a spherical shape reference which may be adjustable. All feeds may be actuated via cables, hydraulics, or mechanical mechanisms (not shown) and may be either partially or fully RF transparent. Feed booms may also be partially or fully RF transparent. Since the focal circle dimension is a function of wavelength, different feeds for different frequencies may simultaneously reside along a properly corresponding different focal circle. For example, a surveillance (turntable) radar scan may occur without colliding with a simultaneous precision tracking (radial) feed scan.

Figure 8:
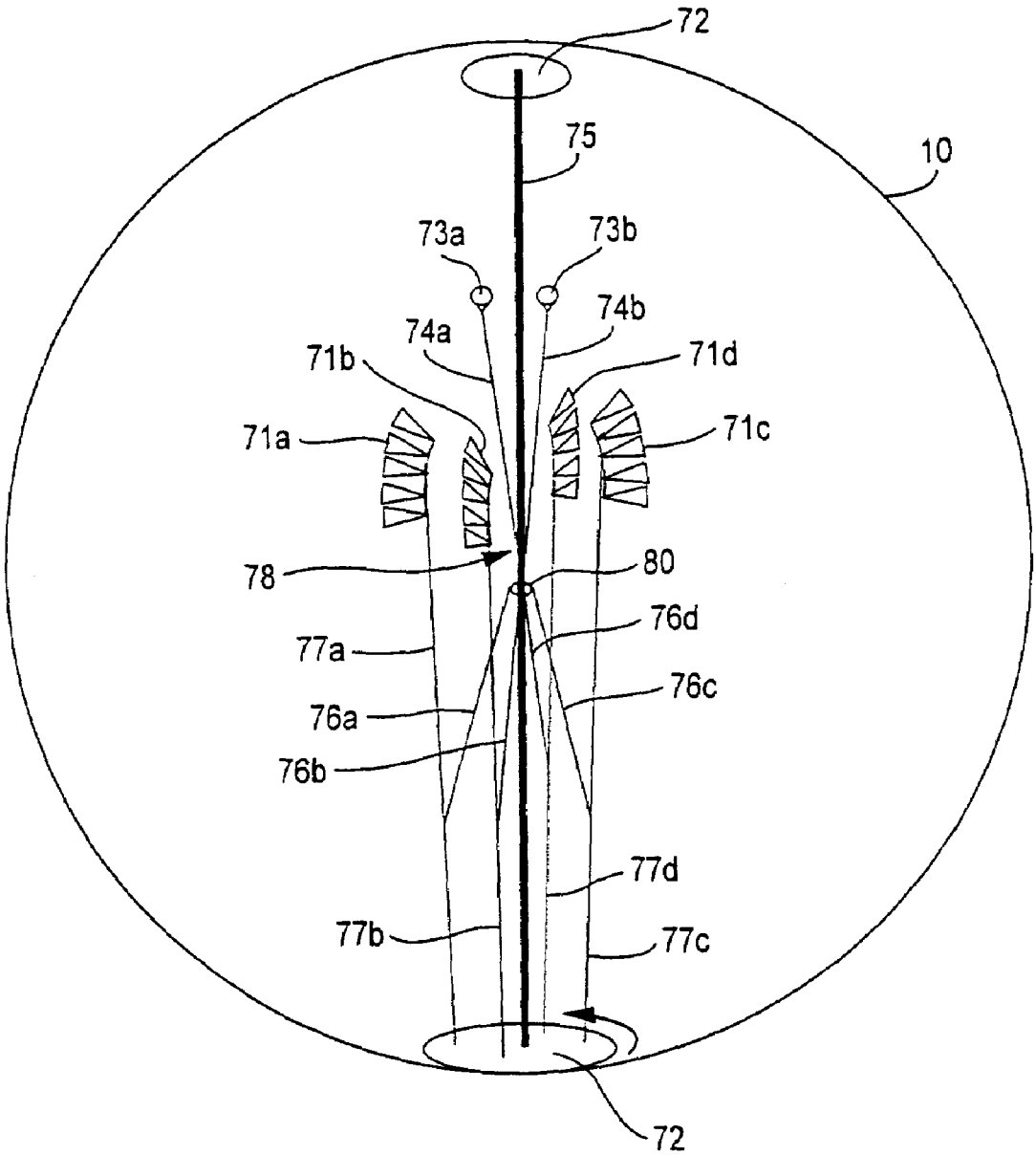

FIG. 8 provides a diagram of the exemplary feed folding mechanism in a collapsed state. Here a sliding ring 80 is slidable along central support post 75 with hinged lateral supports 76*a*–76*d* attached to horn feed guides/main vertical supports 77*a*–77*d* which are, in turn, hinged at their lower, terminations with the rotating turntable 72. The radial supports 74*a*–74*b* for the HF feeds 73*a*, 73*b* are also hinged at 78 where they meet with the central reference pole on their slip ring(s).

Figure 9:
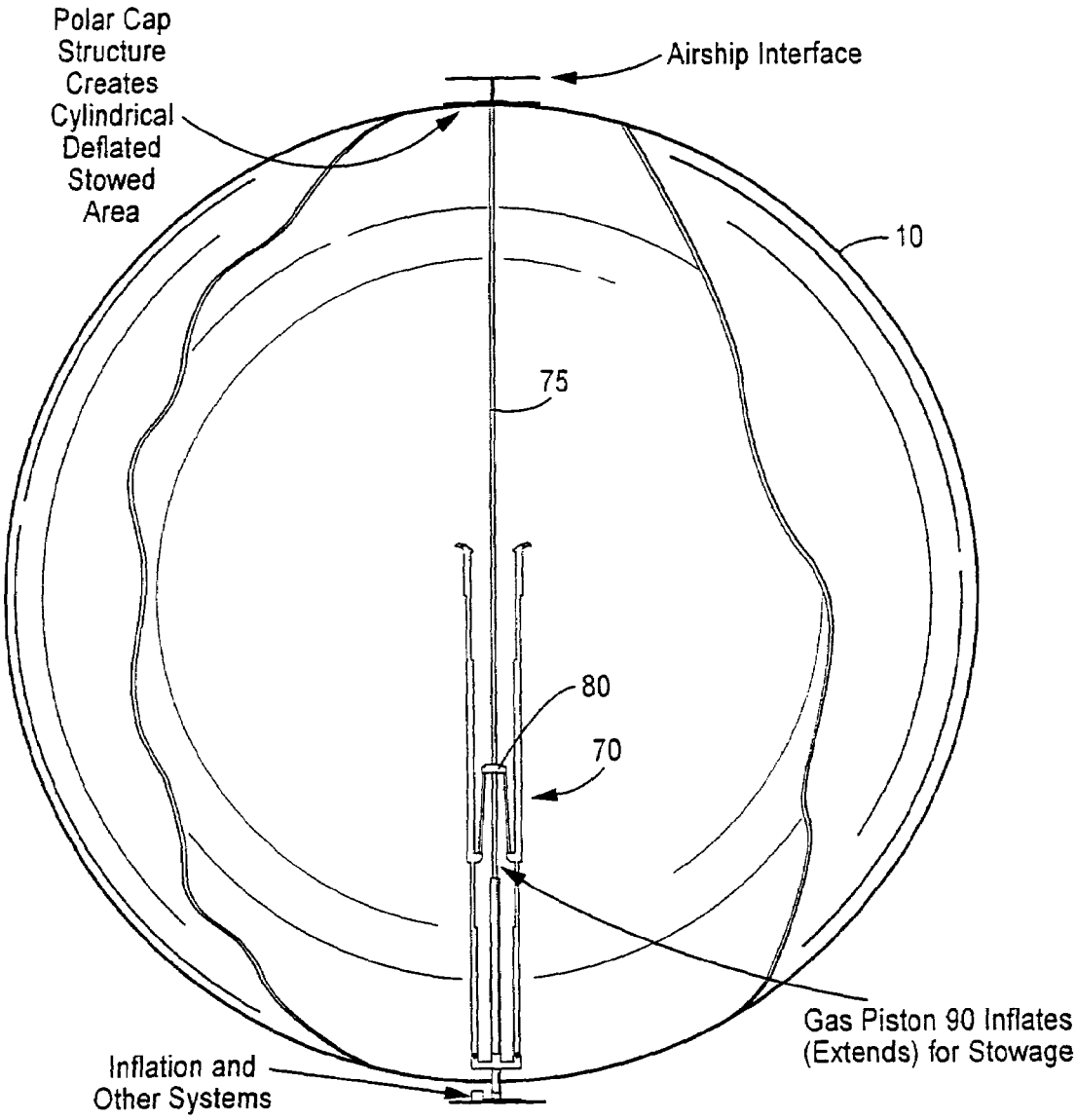

As shown in FIG. 9, the slip ring(s) 80 are controlled in position along central rod 75 (e.g., a pressurized gas cylinder/piston that can be "inflated" to move the slip ring(s) upward to a stowed position for the RF feed apparatus. The radial supports 74*a*, 74*b* may be independently controlled to an upward (or downward) stowed position as shown in FIG. 8 by their regular elevational scanning control mechanism or by engaging linkage to the upwardly moving slip ring(s) 80.

FIG. 9 reflects the stowed position of the feeds for a relatively simple dual RF feed (e.g., as shown in FIG. 6). The gas cylinder/piston 90 in FIG. 9 extends when "inflated", pulling the lateral feed supports up which draws the feed booms in toward the center. A central vertical reference pole 75 (along the sphere's polar axis) is used in a non-rigid airship to ensure that the diameter of the sphere is maintained regardless of what's happening to the airship envelope which is subject to deformation due to winds. The other feeds can either be attached to this reference pole or can use this as a guide via slip rings to achieve the same type of actuation as shown in FIG. 9.

The exemplary embodiments so far described employ a large-aperture spherical transreflector with separate movable point feeds and, optionally, a multi-beam array feed. As depicted in FIG. 1, a boom-mounted horn can feed a portion of the spherical reflector surface to generate a beam in a desired direction. Although the spherically shaped reflector does not form a perfect focus (as would a parabolic reflector), it will still provide a quality beam if a limited portion of the surface is used. Since the sphere is symmetric about its center of curvature, the beam can be steered by moving the feed. The beam quality will not degrade with changes in pointing direction.

Another advantage of the exemplary transreflector design is that it is quite broad-band, a capability that can be exploited by adding separate feeds at other frequencies or adding high-range-resolution waveforms such as in combat ID modes. These capabilities also help in providing clutter and ECM resistance.

Figure 10:
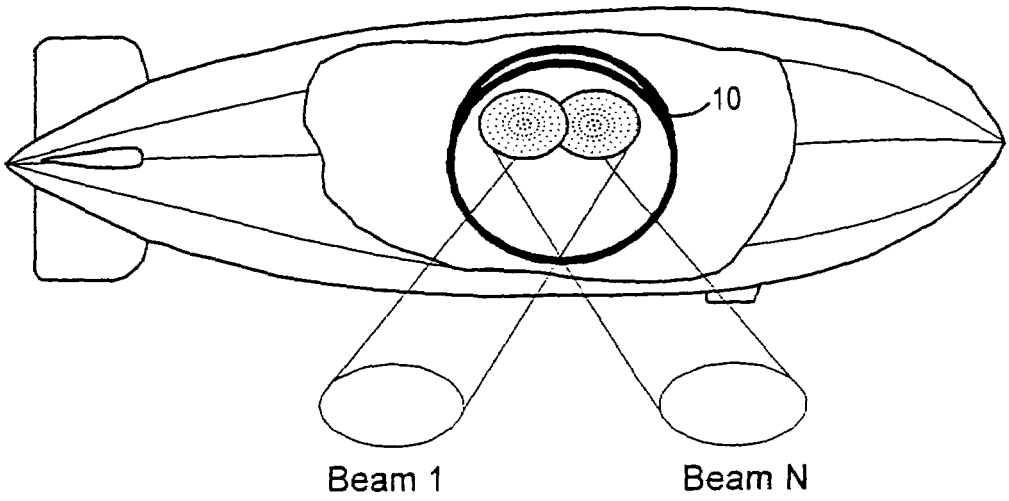
FIG. 10 depicts an exemplary airship application.

To produce high-gain radar beams, scannable over 360° in azimuth, a spherical transreflector is used, similar to the parabolic dome antenna suggested in 1953 [1] and built in 1956 [2]. As shown in FIG. 2A, this antenna uses a grating of strips wrapped at approximately 45° to allow an incoming plane wave to pass through one side, reflect off the opposite side, and come to a focus at about half the sphere radius. Note that for bistatic reception, or using illuminators of opportunity, the incoming waves may not be favorably polarized. Hence, the grating on the incident side of the sphere may reflect some of the incoming energy. For horizontally or vertically polarized waves, this could result in about a 3 dB loss. High-gain beams can be formed and widely scanned by a movable feed located near the sphere half-radius. FIG. 10 shows how the inflatable reflector can be deployed within a high-altitude airship (HAA) platform to simultaneously produce multiple scanning beams.

As earlier noted, we have determined that a spherical transreflector is our preferred shape. One reason is reduced gain loss with scan. Another reason is that to get a non-spherical shape using inflatable technology requires a lenticular construction resulting in a true torus (donut) shape. This would be heavier (requiring sturdy rings at top and bottom and a means to maintain precise separation of the rings) and be more complicated to build and deploy. The spherical transreflector suffers only slightly in terms of peak gain, has much wider scan capability, is lighter and easier to fabricate than non-spherical shapes. Nevertheless, in cases requiring limited elevation scanning, a non-spherical toroidal shape may be preferred.

Some background and underlying rationale for our conclusion regarding a preferred spherical shape for the transreflector are set forth below. In the following section, UHF band (500 MHz) applications are assumed. It may be desirable to choose a higher frequency such as L-band (1 GHz) in other designs. All that is required for changing or adding frequencies is to change or add feed horns (or broader-band feeds) for the desired frequencies.

The primary issues for this antenna may be associated with (1) finding a reflector shape with good wide-angle focusing ability, (2) designing an efficient wide-bandwidth transreflector grating, and (3) providing sufficient surface accuracy with an inflatable structure.

To achieve 360° of azimuthal coverage, the reflector must be a surface of revolution in azimuth. Limited elevation scanning allows more freedom in choosing the shape. Let us first compare the focusing ability of a parabola and a circle. In the vertical plane, a circular cross section may still be desirable for ease of fabrication and lighter mass as previously mentioned. A variety of options for the shape of the vertical plane of the reflector may be considered.

Figure 11B:
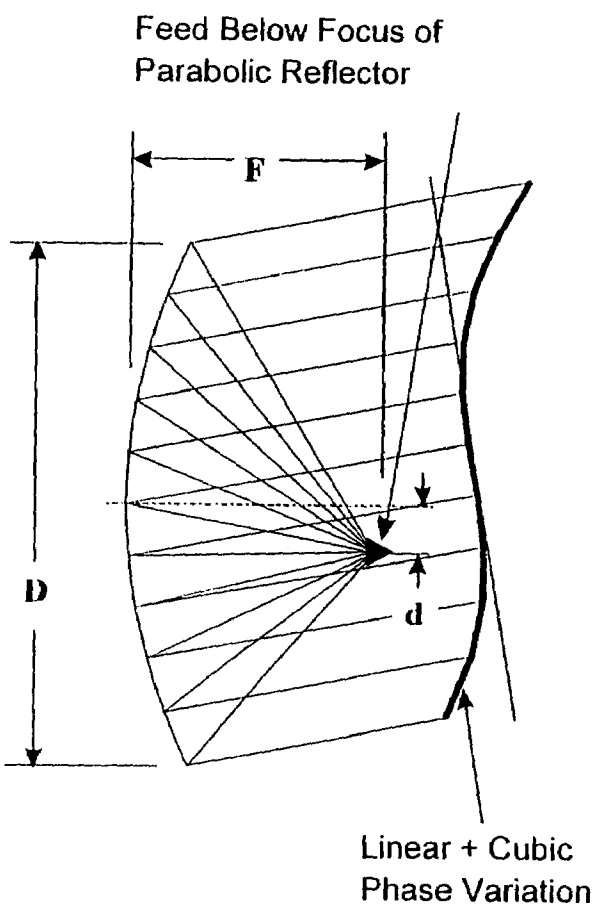
FIG. 11B depicts the phase error of a scanned reflector with the feed moved off the focal point as a scanning mechanism.
Figure 11A:
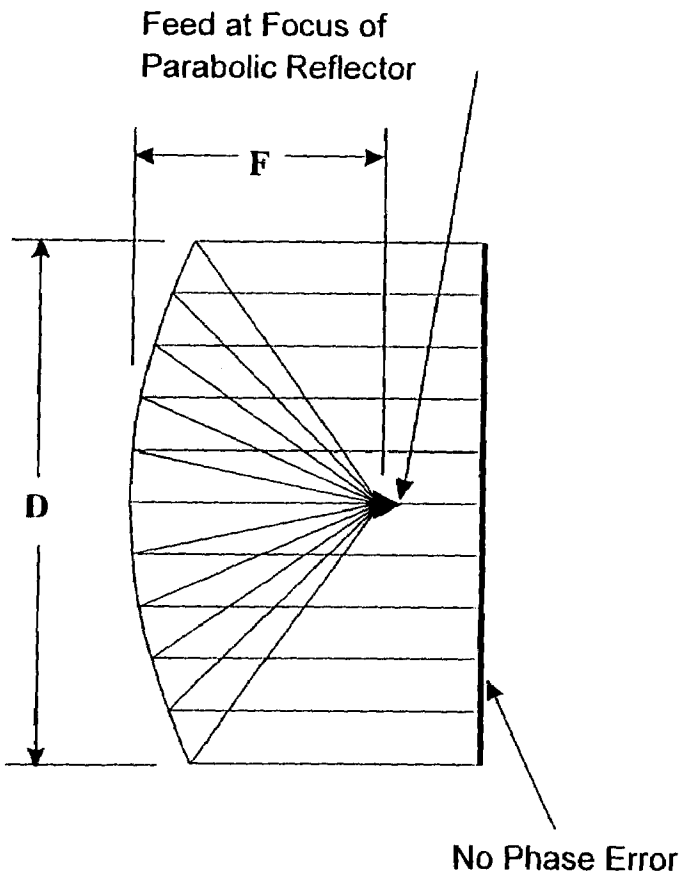
FIG. 11A depicts a parabolic reflector with feed at the focal point.

The focusing characteristics of a parabola and circle can be compared by geometric ray tracing. First consider a focus-fed parabola. FIG. 11A shows that a feed at the focus of a parabola generates a perfect planar phase front. FIG. 11B illustrates that the wave can be scanned by moving the feed laterally off focus, with some cubic degradation of the phase front. The phase error increases with scan, d, and decreases with the ratio of the focus distance divided by the aperture size (i.e., the F/D ratio) [3,4].

For a compact reflector (F/D<0.5), the scan range is limited to a few beamwidths. Larger values for F/D would increase the scan range, but be less compact and require bigger feeds to efficiently illuminate the small angular extent of the reflector.

Figure 12:
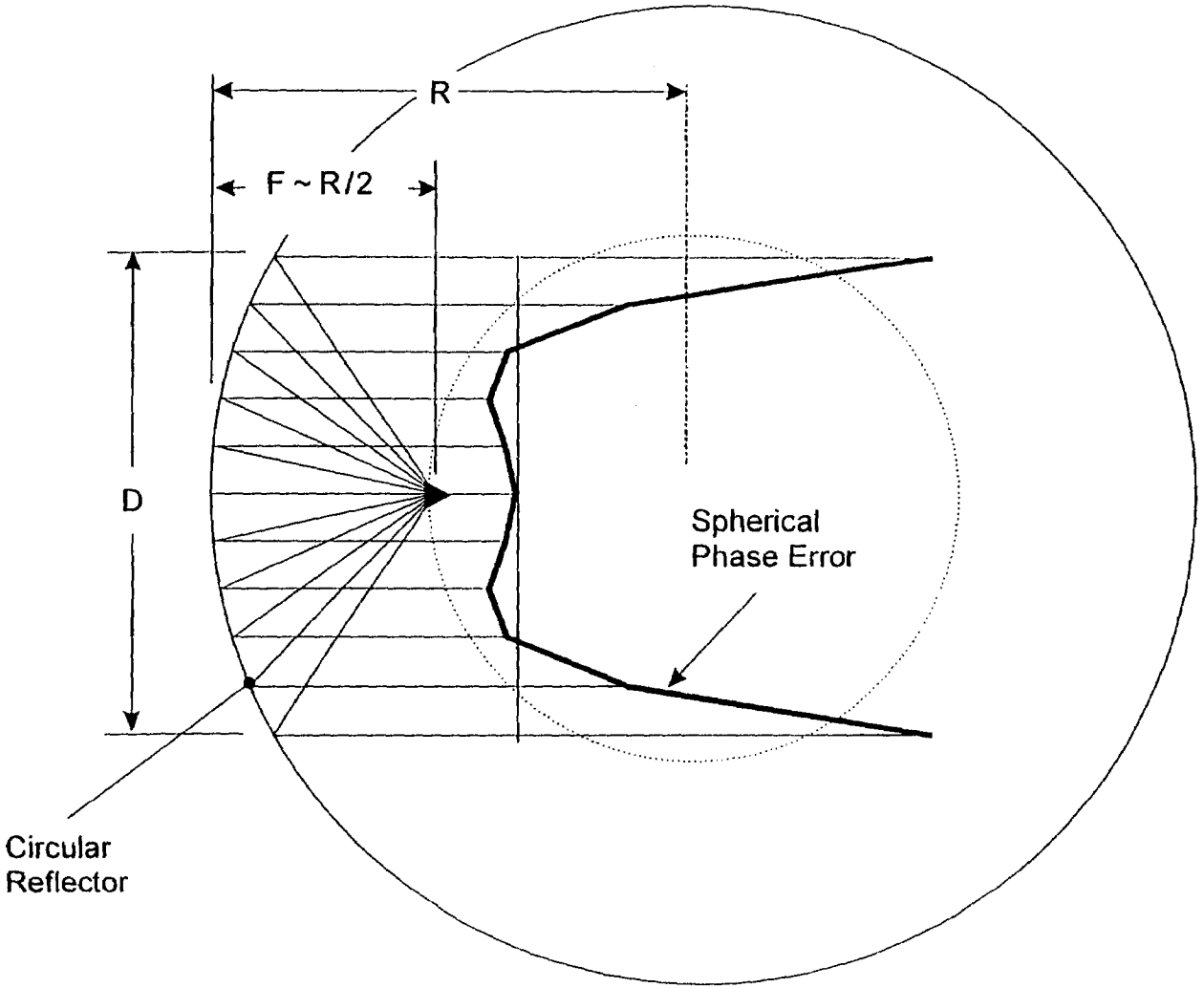
FIG. 12 depicts the phase error of a circular reflector. Note that the optimal feed location is determined by the feed illumination pattern, the wavelength and the reflector size.

Now consider a circle fed from a point near its half radius. FIG. 12 shows that when rays from a point feed reflect from a circle, the resulting phase front contains a spherical phase error with an inflection. The inflection can be optimized to maximize the useful aperture by adjusting the feed location. Rearranging an expression for the maximum useful aperture of a circle [5], yields the following equation for minimum useful F/D:

$$(F/D)_{min} \sim 0.18*(R/\lambda)0.25 \quad (1)$$

where R=circle radius,

λ=wavelength,

D=Aperture diameter, and F=shortest distance from feed to circle.

For a 10-meter-radius circle, the minimum useful F/D at 500 MHz is about 0.36. This low value of F/D means that a large portion of the circle can be used (the result of this calculation is shown in the next section). One advantage that the circle has over any other curve is that the wave can be scanned without further degradation of the phase front.

The preferred curvature in the vertical plane depends on how far the beams need to be scanned in elevation. For the HAA application, since the radar is at high altitude, significant elevation scanning may be required, depending on the mission. Without scanning it might appear that a parabola is best, while significant scanning would favor the circle. However, somewhat surprisingly, even without a requirement to scan in elevation, an ellipse is slightly better than the parabola due to lower diagonal plane phase errors [6]. The next section will quantify these tradeoffs.

This section compares the beamforming performance (directivity) between spherical and parabolic-torus reflectors, as computed by a geometric optics code obtained from C. J. Sletten [7].

To maximize computation speed, only the most heavily illuminated portion of the reflector was modeled (the circular region within the 0 to 10 dB range), shown as D in FIG. 12. This assumption is valid here, since only the values of peak directivity are of interest. In the next section, where patterns are given, the entire reflecting portion of the transreflector was modeled using a physical optics code.

The feed pattern was assumed to have a $\cos^m(\theta)$ pattern variation. Changing parameter "m" varied the size of the illuminated aperture, D. In general, increasing D leads to a larger effective aperture and higher directivity until the maximum phase error exceeds about 90°, when the directivity tops out and then begins to decrease.

Figure 13:
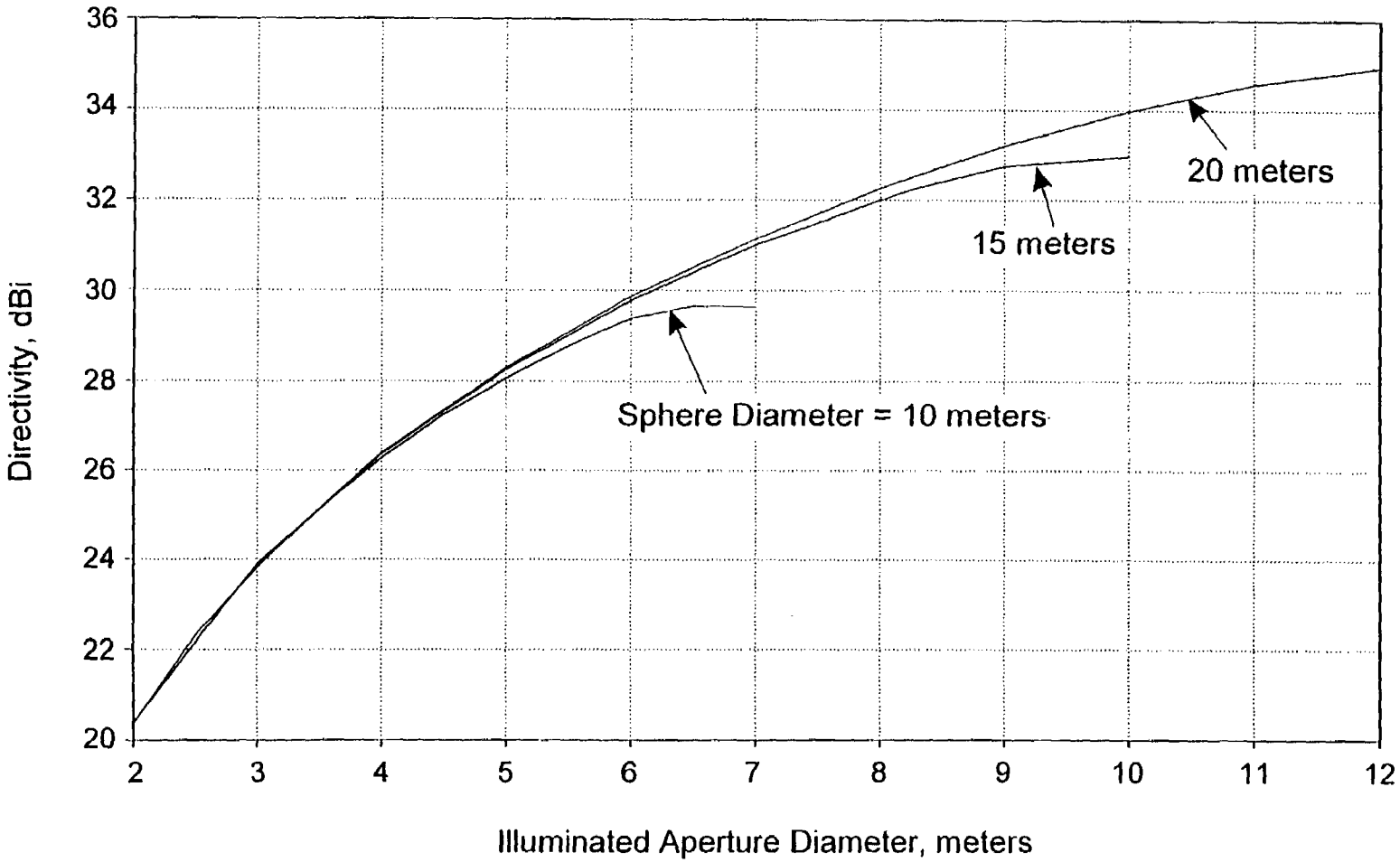
FIG. 13 depicts the directivity of spherical reflectors for F=500 MHz.

For a specific case, first consider a spherical reflector fed from the optimum point slightly outside the half-radius. At UHF, due to lower phase errors, the optimum value of D is about 12 meters, which is predicted by Equation 1. The directivity is plotted against effective illuminated aperture diameter for a variety of sphere sizes in FIG. 13.

The optimum feed point for the sphere used in computing the directivity changes with frequency. This provides a convenient means of avoiding collision between feeds operating in different bands.

In this section, computed antenna patterns for a spherical reflector are given to show that phase errors do not pose a significant limitation on sidelobe level. Here the entire reflecting half of the transreflector (modeled as a solid reflector) is used in the computations to ensure that all phase error effects are accounted for. This is a hemisphere with the poles trimmed off by planes at ±6 meters from the equator. All of the computations presented here used a physical optics code modified from one obtained from D. Paolino of NAWC [9].

For a military application where an interference nulling array might be used, we are more concerned with the average sidelobe level [11]. An estimate of the average sidelobe level can be obtained by assuming that whatever power is not in the main beam must be in the sidelobes.

$$SLL_{avg}=10\log10[4\pi(1-P_{beam})/(4\pi-A_{beam})]\text{dBi} \quad (2)$$

where $P_{beam}$=fraction of total radiated power in the main beam, and $A_{beam}$=main beam area in steradians.

Figure 14:
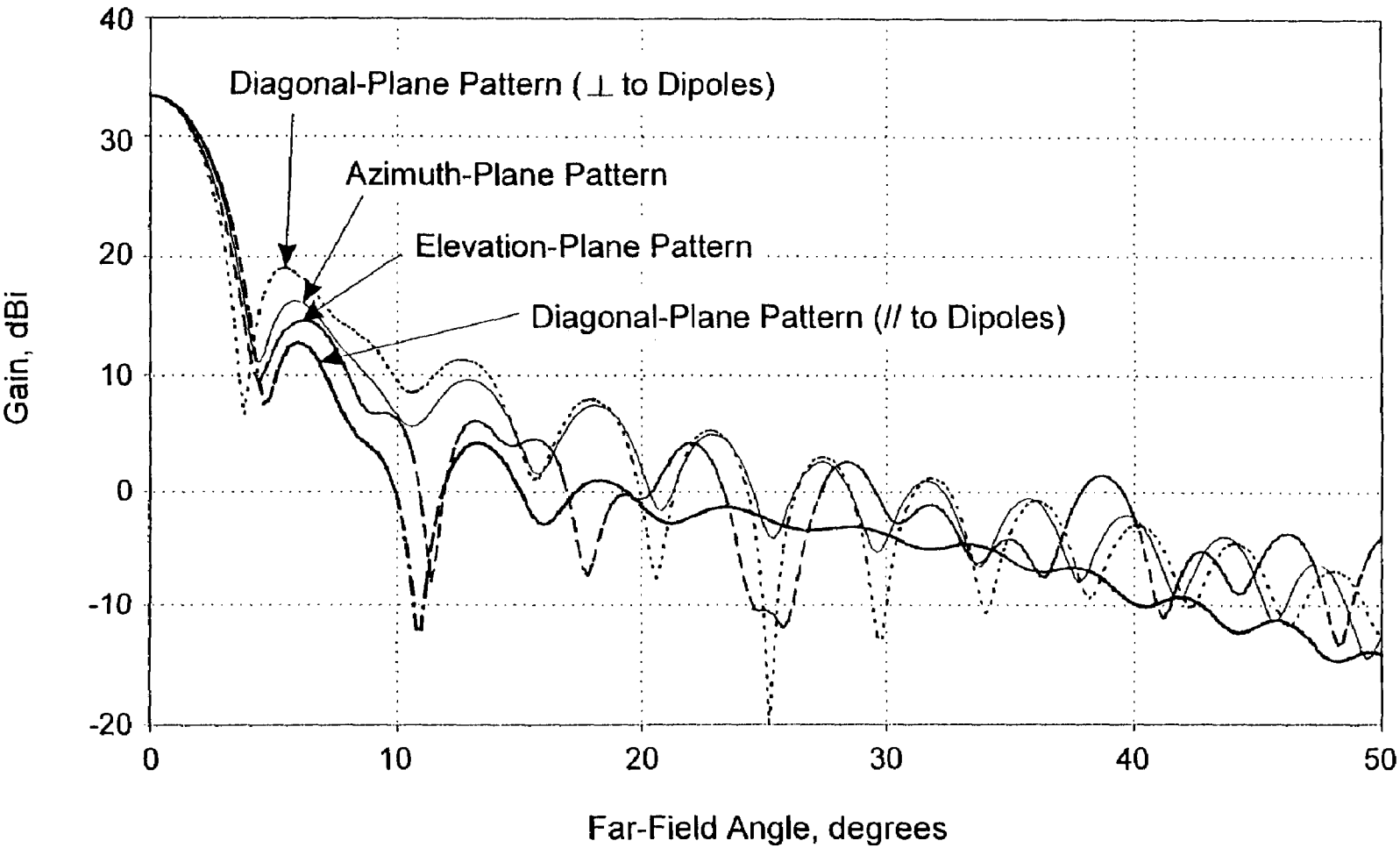
FIG. 14 depicts the gain pattern of a spherical reflector for F=500 MHz having a 2-Element dipole feed.

Now consider gain patterns at 500 MHz. Assume a two-element end-fire array of half-wave dipoles spaced by 0.20 λ oriented for 45° linear polarization. The computed reflector gain patterns over the azimuth, elevation, and diagonal planes are shown in FIG. 14. The peak and average sidelobe levels are about −15 dB and −39.6 dB, respectively, from the beam peak.

Aperture blockage will reduce the gain and increase the sidelobe levels. A first-order estimate of this effect can be computed by subtracting the fields radiated by the blocked portion of the aperture [12]. The effect of blockage is very small until it exceeds about 5% of the effective aperture. From the computed directivity for the 20-meter-diameter spherical reflector, 5% of blockage equates to 4.5 $m^2$ at UHF.

A conservative first-order estimate of the maximum number of feeds that can be accommodated by the reflector can be calculated using the cross-sectional area of the transmission lines leading to the feeds. The feed support structure can be neglected since the supports can be built from non-metallic materials designed for low blockage. The coax transmission lines will have widths of about 2.5 cm at UHF. Assuming a direct path from the feed across the aperture, each feed line would contribute about 0.15 $m^2$ of blockage at UHF, using a 12-meter-diameter aperture. The maximum number of feeds for less than 5% blockage is on the order of 30 beams for UHF. We note that radially supported feeds tend to exhibit more deleterious pattern effects due to the concentration of blockage in the center, or peak amplitude, portion of the antenna pattern.

While the invention has been described in connection with what is presently considered to be the most practical and preferred embodiments, it is to be understood that the invention is not to be limited to the disclosed exemplary embodiments, but on the contrary, is intended to cover various modifications and equivalent arrangements included within the spirit and scope of the appended claims.

What is claimed is:

1. An RF antenna structure comprising:

an inflatable-collapsible RF transreflector surface; and at least one RF feed disposed inside said inflatable-collapsible surface for RF beam scanning movement in elevation and azimuth directions with respect to said surface.

2. An RF antenna structure as in claim 1 wherein said inflatable-collapsible RF transreflector surface substantially conforms to at least a portion of a sphere in shape when inflated.

3. An RF antenna structure comprising:

an inflatable-collapsible RF transreflector surface; and at least one RF feed disposed inside said inflatable-collapsible surface for RF beam scanning movement with respect to said surface;

wherein said inflatable-collapsible RF transreflector surface substantially conforms to at least a portion of a sphere in shape when inflated; and wherein said RF feed is disposed for 360° azimuthal RF beam scanning by rotation around a polar axis of said sphere.

4. An RF antenna structure as in claim 3 wherein said RF feed is disposed for elevational RF beam scanning by angular movements with respect to an equatorial plane of said sphere that is substantially orthogonal to the polar axis of said sphere.

5. An RF antenna structure as in claim 4 wherein said RF feed includes hinged connections arranged to permit folding of the RF feed inward towards said polar axis to accommodate a reduced volume collapsed state of the RF transreflector surface.

6. An RF antenna structure as in claim 5 wherein said RF feed comprises:

at least one support member mounted for slidable movement along said polar axis;

hinged linkages connecting said at least one support member with at least one RF feed conduit; and a controllable mechanical operator disposed to controllably reciprocate said at least one support member along said polar axis.

7. An RF antenna structure as in claim 3 wherein:

at least one first RF feed adapted to operate in a first frequency range is disposed for rotation about the polar axis at a first radius; and at least one second RF feed adapted to operate in a second frequency range, higher than said first frequency range, is disposed for rotation about the polar axis at a second radius, smaller than said first radius.

8. An RF antenna structure as in claim 3 wherein said RF feed includes hinged connections arranged to permit folding inward towards said polar axis to accommodate a reduced volume collapsed state of the RF transreflector surface.

9. An RF antenna structure comprising:

an inflatable-collapsible RF transreflector surface; and at least one RF feed disposed inside said inflatable-collapsible surface for RF beam scanning movement with respect to said surface;

wherein said transreflector surface includes approximately parallel conductive strips arrayed in a curved linear grating pattern on a non-conductive substantially spherical thin film surface when inflated and at an angle of approximately 45° with respect to the sphere equator and along the sphere equator.

10. An RF antenna structure as in claim 9 wherein said conductive strips have a width approximately half the center-to-center spacing between strips.

11. An RF antenna structure as in claim 10 wherein the center-to-center spacing between strips is less than approximately one-eighth of the shortest RF wavelength to be utilized.

12. An RF antenna system as in claim 11 wherein the width and spacing of the conductive strips are narrowed toward the poles of the sphere to increase grating efficiency with elevation scan.

13. An RF antenna structure as in claim 11 wherein said conductive strips have a thickness less than one RF skin depth at the longest RF wavelength to be utilized.

14. An RF antenna structure comprising:

an inflatable-collapsible RF transreflector surface; and at least one RF feed disposed inside said inflatable-collapsible surface for RF beam scanning movement with respect to said surface; wherein:

said inflatable-collapsible RF transreflector surface is mounted within a lighter-than-air conveyance using a lighter-than-air gas to displace air when ascending; and said inflatable-collapsible RF transreflector surface being connected to inflate using said lighter-than-air gas.

15. An RF antenna structure comprising:

an inflatable-collapsible RF transreflector surface; and at least one RF feed disposed inside said inflatable-collapsible surface for RF beam scanning movement with respect to said surface;

wherein said at least one RF feed comprises an array of RF ports which are mounted together for common rotational movement about a polar axis of a substantially spherical RF transreflector surface.

16. An RF antenna system comprising:

an inflatable-collapsible RF transreflector surface; and at least one RF feed disposed inside said inflatable-collapsible surface for RF beam scanning movement with respect to said surface, and plural RF ports circumferentially spaced apart and commonly mounted for simultaneous rotational movement about a polar axis of a substantially spherical RF transreflector surface.

17. An RF antenna system comprising:

an inflatable-collapsible RF transreflector surface; and at least one RF feed disposed inside said inflatable-collapsible surface for RF beam scanning movement with respect to said surface;

wherein said surface comprises plural flat gore sections connected together at overlapping joints whereat metallized strips of a linear grating pattern affixed to each of said sections are capacitively coupled together.

18. An RF antenna system comprising:

a substantially spherical thin film single-wall inflatable-collapsible structure carrying thin conductive metallized strips forming a transreflector grating pattern; and at least one RF port disposed inside said structure for beam scanning movement with respect to said transreflector grating pattern.

19. An RF antenna system as in claim 18 wherein said structure comprises plural flat gore sections connected together at overlapping joints whereat metallized strips of a linear grating pattern affixed to each of said sections are capacitively coupled together.

20. An RF antenna system as in claim 18 wherein said conductive strips have a width approximately half the center-to-center spacing between strips.

21. An RF antenna system as in claim 18 wherein the center-to-center spacing between strips is less than approximately one-eighth of the shortest RF wavelength to be utilized.

22. An RF antenna system as in claim 18 wherein said conductive strips have a thickness less than one RF skin depth at the longest RF wavelength to be utilized.

23. An RF antenna system comprising:

a substantially spherical surface supporting a linear transreflector grating array of conductive strips having a width that is approximately half the center-to-center spacing between strips; and at least one RF port disposed inside said surface for RF beam scanning movement with respect to said grating array.

24. An RF antenna system as in claim 23 wherein the center-to-center spacing between strips is less than approximately one-eighth of the shortest RF wavelength to be utilized.

25. An RF antenna system as in claim 24 wherein said conductive strips have a thickness less than one RF skin depth at the longest RF wavelength to be utilized.

26. An RF antenna system as in claim 23 wherein said conductive strips have a thickness less than one RF skin depth at the longest RF wavelength to be utilized.

27. An RF antenna system as in claim 23 wherein said spherical surface is defined by an inflatable-collapsible thin film.

28. An RF antenna system as in claim 27 wherein said inflatable-collapsible RF transreflector surface is mounted within a lighter-than-air conveyance using a lighter-than-air gas to displace air when ascending; and said inflatable-collapsible RF transreflector surface being connected to inflate using said lighter-than-air gas.

29. An RF antenna system as in claim 23 wherein said RF feed is disposed for 360° azimuthal RF beam scanning by rotation around a polar axis of said sphere.

30. An RF antenna system as in claim 29 wherein said RF feed is disposed for elevational RF beam scanning by angular movements with respect to an equatorial plane of said sphere that is substantially orthogonal to the polar axis of said sphere.

31. An RF antenna system as in claim 29 wherein at least one first RF feed adapted to operate in a first frequency range is disposed for rotation about the polar axis at a first radius; and at least one second RF feed adapted to operate in a second frequency range, higher than said first frequency range, is disposed for rotation about the polar axis at a second radius, smaller than said first radius.

32. An RF antenna system as in claim 23 wherein said RF feed is disposed for elevational RF beam scanning by angular movements with respect to an equatorial plane of said sphere that is substantially orthogonal to the polar axis of said sphere.

33. An RF antenna system as in claim 32 wherein said RF feed comprises:

at least one support member mounted for slidable movement along said polar axis;

hinged linkages connecting said at least one support member with at least one RF feed conduit; and a controllable mechanical operator disposed to controllably reciprocate said at least one support member along said polar axis.

34. An RF antenna system as in claim 23 wherein the width and spacing of the conductive strips are narrowed toward the poles of the sphere to increase grating efficiency with elevation scan.

35. A method of operating an RF antenna structure, said method comprising:

inflating an inflatable-collapsible RF transreflector surface; and moving at least one RF feed disposed inside said inflatable-collapsible surface for RF beam scanning movement in elevational and azimuth directions with respect to said surface.

36. A method as in claim 35 wherein said inflatable-collapsible RF transreflector surface substantially conforms to at least a portion of a sphere in shape when inflated.

37. A method of operating an RF antenna structure, said method comprising:

inflating an inflatable-collapsible RF transreflector surface; and moving at least one RF feed disposed inside said inflatable-collapsible surface for RF beam scanning movement with respect to said surface;

wherein said inflatable-collapsible RF transreflector surface substantially conforms to at least a portion of a sphere in shape when inflated; and wherein said RF feed is rotated for 360° azimuthal RF beam scanning around a poiar axis of said sphere.

38. A method as in claim 37 wherein said RF feed is angularly moved for elevational RF beam scanning with respect to an equatorial plane of said sphere that is substantially orthogonal to the polar axis of said sphere.

39. A method as in claim 38 wherein said RF feed is folded at hinged points of the RF feed inward towards said polar axis to accommodate a reduced volume collapsed state of the RF transreflector surface.

40. A method as in claim 39 wherein:

a controllable mechanical operator controllably reciprocates at least one support member of the RF feed along said polar axis.

41. A method as in claim 37 wherein:

at least one first RF feed adapted to operate in a first frequency range is rotated about the polar axis at a first radius; and at least one second RF feed adapted to operate in a second frequency range, higher than said first frequency range, is rotated about the polar axis at a second radius, smaller than said first radius.

42. A method as in claim 37 wherein said RF feed is folded inward towards said polar axis to accommodate reduced volume collapsed state of the RF transreflector surface.

43. A method of operating an RF antenna structure, said method comprising:

inflating an inflatable-collapsible RF transreflector surface; and moving at least one RF feed disposed inside said inflatable-collapsible surface for RF beam scanning movement with respect to said surface, wherein said transreflector surface includes approximately parallel conductive strips arrayed in a linear grating pattern on a non-conductive substantially spherical thin film surface when inflated and at an angle of approximately 45° with respect to the sphere equator and along the sphere equator.

44. A method as in claim 43 wherein said conductive strips have a width approximately half the center-to-center spacing between strips.

45. A method as in claim 44 wherein the center-to-center spacing between strips is less than approximately one-eighth of the shortest RF wavelength to be utilized.

46. A method as in claim 45 wherein said conductive strips have a thickness less than one RF skin depth at the longest RF wavelength to be utilized.

47. A method as in claim 45 wherein the width and spacing of the conductive strips are narrowed toward the poles of the sphere to increase grating efficiency with elevation scan.

48. A method of operating an RF antenna structure, said method comprising:

inflating an inflatable-collapsible RF transreflector surface; and moving at least one RF feed disposed inside said inflatable-collapsible surface for RF beam scanning movement with respect to said surface, wherein:

said inflatable-collapsible RF transreflector surface is mounted within a lighter-than-air conveyance using a lighter-than-air gas to displace air when ascending; and said inflatable-collapsible RF transreflector surface is inflated using said lighter-than-air gas.

49. A method of operating an RF antenna structure, said method comprising:

inflating an inflatable-collapsible RF transreflector surface; and moving at least one RF feed disposed inside said inflatable-collapsible surface for RF beam scanning movement with respect to said surface, wherein said at least one RF feed comprises an array of RF ports which are mounted together for common rotational movement about a polar axis of a substantially spherical RF transreflector surface.

50. A method of operating an RF antenna structure, said method comprising:

inflating an inflatable-collapsible RF transreflector surface; and moving at least one RF feed disposed inside said inflatable-collapsible surface for RF beam scanning movement with respect to said surface, and plural RF ports circumferentially spaced apart and commonly mounted for simultaneous rotational movement about a polar axis of a substantially spherical RF transreflector surface.

51. A method of operating an RF antenna structure, said method comprising:

inflating an inflatable-collapsible RF transreflector surface; and moving at least one RF feed disposed inside said inflatable-collapsible surface for RF beam scanning movement with respect to said surface, wherein said surface comprises plural flat gore sections connected together at overlapping joints whereat metallized strips of a linear grating pattern affixed to each of said sections are capacitively coupled together.

52. A method of operating an RF antenna system, said method comprising:

inflating a substantially spherical thin film single-wall inflatable-collapsible structure carrying thin conductive metallized strips forming a transreflector grating pattern; and moving at least one RF port disposed inside said structure for beam scanning movement with respect to said transreflector grating pattern.

53. A method of operating an RF antenna system, said method comprising:

generating a substantially spherical surface supporting a linear transreflector grating array of conductive strips having a width that is approximately half the center-to-center spacing between strips; and moving at least one RF port disposed inside said surface for RF beam scanning movement with respect to said grating array.

54. A method as in claim 53 wherein the center-to-center spacing between strips is less than approximately one-eighth of the shortest RF wavelength to be utilized.

55. A method as in claim 54 wherein said conductive strips have a thickness less than one RF skin depth at the longest RF wavelength to be utilized.

56. A method as in claim 54 wherein the width and spacing of the conductive strips are narrowed toward the poles of the sphere to increase grating efficiency with elevation scan.

57. A method as in claim 53 wherein said conductive strips have a thickness less than one RF skin depth at the longest RF wavelength to be utilized.

58. A method as in claim 53 wherein said generating step includes inflation of an inflatable-collapsible thin film.

59. A method as in claim 58 wherein:

said inflatable-collapsible RF transreflector surface is mounted within a lighter-than-air conveyance using a lighter-than-air gas to displace air when ascending; and said inflatable-collapsible RF transreflector surface is inflated using said lighter-than-air gas.

60. A method as in claim 53 wherein said RF feed is rotated for 360° azimuthal RF beam scanning around a polar axis of said sphere.

61. A method as in claim 60 wherein said RF feed is angularly moved for elevational RF beam scanning with respect to an equatorial plane of said sphere that is substantially orthogonal to the polar axis of said sphere.

62. A method as in claim 60 wherein at least one first RF feed operates in a first frequency range and is disposed for rotation about the polar axis at a first radius; and at least one second RF feed operates in a second frequency range, higher than said first frequency range and is disposed for rotation about the polar axis at a second radius, smaller than said first radius.

63. A method as in claim 53 wherein said RF feed is angularly moved for elevational RF beam scanning with respect to an equatorial plane of said sphere that is substantially orthogonal to the polar axis of said sphere.

64. A method as in claim 63 wherein using a controllable mechanical operation to controllably reciprocate at least one support member for the RF feed along said polar axis.

* * * * *